US007841308B1

(12) United States Patent
Muth

(10) Patent No.: US 7,841,308 B1
(45) Date of Patent: Nov. 30, 2010

(54) ROTARY VALVE IN AN INTERNAL COMBUSTION ENGINE

(76) Inventor: Barry A. Muth, 2721 Clifton Ave., Creedmoor, NC (US) 27522

( * ) Notice: Subject to any disclaimer, the term of this patent is extended or adjusted under 35 U.S.C. 154(b) by 320 days.

(21) Appl. No.: 12/098,636

(22) Filed: Apr. 7, 2008

(51) Int. Cl.
*F02B 75/20* (2006.01)
*F01L 7/08* (2006.01)

(52) U.S. Cl. ..... 123/80 DA; 123/59.4; 123/80 BB; 123/190.4; 123/568.11

(58) Field of Classification Search ..... 123/59.1–59.4, 123/190.1, 190.4–190.12, 80 R, 80 BA, 80 BB, 123/80 C, 80 D, 80 DA, 58.8, 568.11–568.32
See application file for complete search history.

(56) References Cited

U.S. PATENT DOCUMENTS 2,394,767 A * 2/1946 Hall ..... 123/80 DA
4,867,117 A * 9/1989 Scalise ..... 123/190.8
5,474,036 A * 12/1995 Hansen et al. ..... 123/80 BB
5,579,734 A 12/1996 Muth
5,816,203 A 10/1998 Muth
6,155,215 A 12/2000 Muth
6,513,475 B2 2/2003 Muth

* cited by examiner

*Primary Examiner*—Noah Kamen
(74) *Attorney, Agent, or Firm*—Coats & Bennett, P.L.L.C.

(57) ABSTRACT

A rotary valve engine using a single rotary valve serving multiple cylinders significantly increases both volumetric and thermodynamic efficiencies. A novel stratified three stage low temperature combustion system reduces both heat transfer loss and combustion process irreversibility. Using large intake and exhaust valves and passages to reduce throttling losses, the rotary valve also contains a combustion valve and passage connected to a central combustion chamber. Combustion is initiated for all cylinders by a fuel injector in this central chamber which then sequentially ignites a second combustion chamber charge located in each cylinder head. A passage in the rotary valve shaft transfers gas from the combustion cycle to the compression cycle varying the compression ratio of the engine, producing EGR, and transferring radical species for combustion to the next cycle. A compounding element on the rotary valve extracts additional thermal energy derived from reduced heat transfer loss and increased energy.

29 Claims, 8 Drawing Sheets

ROTARY VALVE IN AN INTERNAL COMBUSTION ENGINE

FIELD OF THE INVENTION

The present invention relates generally to internal combustion engines, and more particularly, to an internal combustion engine utilizing a rotary valve for directing the flow of intake air into the cylinders and exhausting gases from the cylinders.

BACKGROUND OF THE INVENTION

Currently, the most widely used engines are the Diesel and Otto spark ignited (SI) engines. While these engines offer remarkable performance at a relatively low cost, their basic design of over one hundred years ago is in need of serious improvement in the areas of thermal and pumping efficiency, emissions, and fuel economy. Refinement of the design of both engine types has improved the performance of these engines in recent decades. However, major improvements in the future are unlikely as this mature design is restricted by basic design limitations.

One serious limitation is the volume of air which can be pumped through the engine. Pumping volume has historically been increased through incorporating larger intake and exhaust valve openings and by supercharging. The total possible valve opening size of the intake and exhaust valves has been effectively reached in recent years with the use of multiple intake and exhaust valves per cylinder. The valve opening limit is imposed by the physical dimensions of the head and the need to have the intake and exhaust valves, and the ignition device located in the same physical proximity.

Another important limitation of conventional engines is thermal efficiency. While the diesel engine offers higher thermal efficiencies than the SI engine, both engine types use dedicated combustion chamber designs for each cylinder. Thus, the cylinder walls and combustion chambers transfer and lose heat thereby reducing thermal efficiency. Adding to this problem is the use of single stage combustion systems which have large temperature differences between the reactants of the fuel and air and the products (exhaust). This increases thermodynamic entropy.

In recent years, the importance of fuel economy has increased with the dramatic increase in fuel prices. Although diesel engines are more fuel efficient than SI engines, diesels suffer from lack of power and produce more noise and vibration than SI engines. This has greatly reduced the acceptance of diesel technology in the US and the fuel savings they provide.

Emissions, especially NOx, CO2, and soot are problematic in conventional engine technology. Diesel engines are prone to producing NOx and soot while SI engines have elevated CO2 emissions which is a major contributor to global warming. Since, the effects of global warming are of increasing concern, CO2 emissions need to be addressed as well as all other emissions to meet increasingly stringent emissions regulations. Reductions in CO2 emissions are best accomplished by burning less fuel, or put another way, increasing fuel mileage. Increasing fuel mileage would then require vehicle weight reduction, reducing output, increasing engine efficiency, or some combination of these. Reducing output is the least costly option, but consumers of light duty vehicles have historically shown a distinct preference for high output vehicles as well as vehicles with many options which increases weight. This presents a real dilemma for manufacturers of these vehicles since conventional technology cannot simultaneously increase output, weight, fuel economy, and emissions in a cost effective manner.

Long-term, the best way to reduce emissions and fuel consumption without decreasing output is to increase the overall engine efficiency. Current developments in conventional technology show promise in emissions reduction with new combustion techniques such as Homogeneous Charge Compression Ignition, Low Temperature Combustion, Stratified Charge, and Stratified Charge Radical Ignition. However, these techniques make little or no increase in engine efficiency and some cannot operate over all load and speed ranges.

Other engine designs also have their own inherent problems. Two stroke versions of the Diesel and Otto engines have considerably higher power-to-weight ratios, but due to inefficient scavenging are not as thermally efficient and have considerably inferior emissions characteristics. Rotary engines with their large combustion surfaces also are not as thermally efficient and exhibit higher emissions although they posses high power-to-weight characteristics. Finally, rotary valve engines can exhibit high power-to-weight ratios, but historically have been plagued by sealing problems leading to either excessive seal wear or oil consumption.

However the rotary valve engine has some intriguing characteristics if it could overcome the sealing problem. First, consider the typical rotary valve engine having one rotary valve per cylinder. The rotary valve engine can be constructed without the need to have hot exhaust valves in the combustion chamber. This allows the compression ratio in SI engines to be increased producing both increased thermal efficiency and output. Further, rotary engines can operate at significantly increased RPMs to produce even greater output. In addition, rotary valve engines would be expected to exhibit emissions similar to four stroke conventional engines, but with the right combustion chamber and valve geometry, could outperform them. Finally, rotary valve engines require fewer parts than conventional engines which should increase reliability while decreasing the manufacturing cost. These characteristics may explain why interest in them remains so high.

Considering these advantages, closer inspection of the seal problem is warranted. One of the more promising designs was the Aspin rotary valve engine using a conical shaped rotary valve seated against a ring seal above it. As was typical of most rotary valve engines, combustion pressures were exerted against the seals to increase combustion chamber sealing. The resultant pressures on the seals required them to be well lubricated to prevent excessive seal wear or rotary valve seizure. However, adequate lubrication of the seals produced excessive oil consumption while reducing the lubrication produced excessive seal wear. No solution was ever found to this problem.

Another promising design was the 1950 era NSU single cylinder rotary valve motorcycle engine. This was a vertical disc valve engine using a ring seal below the valve to seal the combustion chamber. This seal also exhibited excessive wear from exposure to combustion pressures. A later version using a single valve serving two cylinders was tested. Due to a slight performance advantage, the NSU engine apparently was a successful race engine but was abandoned in favor of development of the Wankel rotary engine.

Contrary to the other engines discussed which limit efficiency gains due to basic design constraints, the rotary valve engine seal problem is due to the failure to find a technical engineering solution. One answer to this technical problem may have already been found by Coates International Ltd. This spherical rotary valve design apparently has overcome the seal problem but reliability of the engines is unknown. It should be pointed out; the Wankel rotary engine originally also was unsuccessful due to excessive seal deterioration. After the demise of NSU due to their inability to solve this problem, it took the resources of Toyo Kogyo (Mazda) to finally solve the remaining engineering issues to make the Wankel rotary engine successful. With normal maintenance, the seal systems of present Wankel rotary engines should last approximately 300,000 miles. Given the eventual success of the Wankel rotary engine, one has to believe that if the NSU rotary valve engine would have received the same resources, the seal problem would have been solved to produce a successful rotary valve engine.

All three rotary valve engines cited claim performance advantages. However, none is independently documented. The Coates engine also claims increased volumetric efficiency, but this claim is suspect due to no claim of actually increasing the valve opening areas, although some increased pumping efficiency is likely at high engine speeds. With respect to thermal efficiency, some gain in SI rotary valve engines is likely due to increased compression ratios. Additional thermodynamic gains are unlikely since all the rotary valve engines cited utilize combustion chamber geometries similar to conventional poppet valve engines.

The internal combustion engine is a heat engine. As such, increases in engine efficiency will need to address the areas where there are the greatest heat losses or more technically, the greatest thermodynamic entropy. These are the combustion process which generates thermodynamic irreversibility and the transfer and loss of heat to various combustion surfaces. Thermodynamic irreversibility is created by the combustion reactions transforming fuel energy into molecular motion and heat. This heat energy is unavailable for work and is lost. Typically, reducing the thermodynamic irreversibility only serves to increase exhaust heat losses. Therefore, significant increases in thermodynamic efficiency will require reducing heat losses to the cylinder and combustion chambers, reducing thermodynamic irreversibility and recapturing exhaust heat energy to produce useful work. This implies that significant energy efficiency improvements will necessitate substantial changes in engine architecture.

SUMMARY AND OBJECTS OF THE INVENTION

The Rotary Valve Engine (RVE) presented makes significant improvements in volumetric and thermodynamic engine efficiency to significantly increase output and fuel economy while reducing emissions. Thermodynamic efficiency is significantly improved by reducing the fuel energy losses of the two largest contributors to thermodynamic entropy. These contributors are combustion process irreversibility and heat transfer loss. In the preferred embodiment of the RVE, a single rotary valve serves four cylinders of a four cycle engine.

This art describes a novel combustion system to improve thermodynamic efficiency. First, the RVE has a conventional combustion chamber located in each cylinder head. However, this art utilizes a compound combustion system which adds a combustion chamber located in the rotary valve which serves all four cylinders. This stratified three stage combustion system starts the process by low pressure injection of fuel into the intake charge. Hot exhaust gas heats the intake charge as it passes through the intake passage by counterflow heat exchange. Another novel element, the variable compression valve, adds hot gas to the intake charge. The variable compression valve is an opening located in the shaft of the rotary valve which is opened and closed by an electronically controlled ring surrounding the rotary valve shaft. The variable compression valve transfers gas from the combustion cycle cylinder to the compression cycle cylinder to change the compression ratio, perform exhaust gas recirculation (EGR), and transport radical species. Stage one combustion ends with the compression of the charge to just under the ignition temperature. Stage two combustion starts with the opening of another novel element, the combustion valve. Also located in the rotary valve, the combustion valve operates similarly to the intake and exhaust valves allowing gas to sequentially enter from each cylinder in succession. A portion of the charge enters a passage which leads to the next novel element, the rotary valve combustion chamber (RVCC). The combustion valve is designed to access the RVCC late in the compression cycle and remains open during the combustion cycle. The RVCC is served by a single centrally located injector which injects fuel preheated by the block. As the piston continues to rise and push the charge from the head combustion chamber through the combustion valve, the added volume of the RVCC significantly reduces the rate of pressure rise of the charge decreasing the work done by the piston. To insure auto-ignition of the charge when the fuel is injected into the RVCC, the initial intake charge pressure is greatly increased. The increased charge pressure is generated by supercharging the intake charge and by increasing the compression ratio with the variable compression valve. As the charge enters the RVCC, it thoroughly and rapidly mixes with the injected fuel as it passes the RVCC injector to initiate combustion. Stage three of the combustion cycle begins with ignition of the head combustion chamber charge caused by the dramatically increased combustion chamber pressure due to ignition of the RVCC charge. At the conclusion of the combustion cycle, the combusted gases exit through a compounding element composed of angled or curved fins providing force against the rotary valve to increase output.

In addition to diesel and gasoline, the RVE can utilize other fuels such as biodiesel, ethanol, natural gas, hydrogen and other related fuels. Note, in this document, RVD will always refer to the diesel version (Rotary Valve Diesel), while RVE can refer to both, but usually to the SI version. Further, for the purposes of comparison, conventional compression ratios for direct injection (DI) diesel and SI engines are assumed. However, as will be pointed out later, the RVD can be operated with compression ratios lower than current conventional diesel technology while the SI RVE can function with compression ratios substantially higher than conventional SI engines.

As the operation of the RVE is described, it will become apparent the design is very flexible. This is evidenced by the ability to easily operate with many fuels, and also to utilize two different approaches to efficient operation. Described below is a method to increase efficiency by reducing the irreversibility of the engine. Generally this involves keeping the reactant temperatures as high as possible. However, the increased availability comes at the expense of increased work to compress the intake charge which reduces engine efficiency. An alternate method is to keep the intake charge as cool as possible to minimize compression work. This method is later illustrated in the detailed description of the invention. Currently, it is unclear whether either method has an efficiency advantage. However, future development of more thermally resistant materials and lubricants should advance efficiency gains in the area of increased temperature reactants.

The combustion system of the RVE produces many benefits. First, it increases output. Since the total combustion chamber volume depicted in the RVD is three times conventional using conventional compression ratios, output is effectively tripled without increasing the cylinder displacement or combustion pressure. In the SI RVE, the increased volume would double output, but output can be further increased because the compression ratio can be dramatically increased due to several factors. First, the charge pressure is kept sufficiently low and the fuel mixture sufficiently lean to prevent combustion in the head combustion chamber until the large pressure rise created by the RVCC ignites it. Second, the RVE does not have hot engine components (valves or spark plug) extending into the head combustion chamber which could cause pre-ignition. Third, the charge in the RVCC cannot ignite until a sufficient quantity of fuel is injected by the fuel injector in the RVCC which is then ignited by either auto-ignition or by the spark plug. Output in both versions is further increased due to higher torque production. The increased torque is created by the sequential auto-ignition in the RVCC and head combustion chambers producing a slower overall heat release putting more force against the piston at later crank angles. Again in both, output is further increased by increasing engine RPMs. RPMs can be increased due to the rotary valve being mechanically more capable of rotating faster than poppet valves can reciprocate and due to the lightweight pistons. Further, reduced ignition delay increases RPMs. The faster ignition is produced by the relatively high heat retention of the RVCC and the high energy jets generated by it to ignite the head combustion charge, and the insertion of radical species transported by the variable compression valve. Finally, the compounding element captures normally lost heat energy and applies this energy to the crankshaft via the rotary valve to further increase output.

Another benefit is increased thermal efficiency. First, the RVE compound combustion system loses less heat to the cylinder and combustion chamber surfaces than conventional engines. The RVCC is exposed only to already hot compressed gas from the late compression cycle and the hot gas of the combustion cycle reducing its thermal operating range. Also, the RVCC is used in every cycle, creating only very brief periods when it is exposed to the lower heat range. In addition, the same part of the rotary valve is always above the cylinder operating in the same engine cycle. This is very important because combustion surfaces have a "heat memory". Therefore, keeping the same areas constantly exposed to the same heat range minimizes heat transfer. Second, the RVE uses much higher intake charging (Miller cycle) and the RVCC increases the total combustion chamber volume allowing increased output without increasing cylinder displacement. These allow the engine displacement to be dramatically reduced to produce the same output with a much smaller cylinder and combustion surface area. Third, in the RVD, the compression ratio needed to ignite the fuel is substantially reduced by minimizing heat loss with the use of ceramic coatings, hot EGR, and the transportation of relatively hot radicals into the compression charge. Forth, the resultant low temperature combustion reduces heat loss. Fifth, the compounding element captures exhaust heat energy normally lost to the environment and is always positioned at the beginning of the exhaust stream to maximize the amount of heat energy recovered from all cylinders. This is in stark contrast to conventional piston engines where the exhaust manifolds are spread out thereby losing great quantities of heat energy making exhaust heat recovery difficult. This problem is compounded by the reduced heat availability with more efficient engine operation and with low temperature combustion techniques. While the heat availability is similarly reduced in the RVE with higher thermal efficiency and low temperature combustion, the RVE is designed to minimize heat transfer losses making more heat energy available to recoup with a compounding element.

In comparison to conventional engines, the RVE reduces combustion process losses. Less heat energy is lost because the reactants of the fuel and intake air are, or can be, preheated closer to chemical equilibrium. Staging of the combustion events allows more preheating of the reactants before combustion. Stage one uses several methods to preheat the charge. Although not shown, the RVE can easily use hot exhaust gas for EGR. Since all the exhaust gas is located in one short passage immediately adjacent to the single intake passage opening, less heat energy would be lost if the exhaust was used to dilute and heat the intake charge. Conventional engines mix much cooler exhaust gas with the intake air for EGR or employ internal EGR which reduces pumping efficiency. Again due to close proximity, heat energy from the exhaust, RVCC and bottom surface of the rotary valve can be transferred via conduction to preheat the intake charge contained within the annular cavity and intake passage as it passes through the valve. Additionally, the RVE transfers hot cylinder combustion chamber gas to the compression cycle to perform the various variable compression valve functions. Stage one ends with the compression of the reactants to just under the ignition temperature. Stage two starts with the opening of the combustion valve as it transports a portion of the charge into an already hot RVCC. The hot compression charge from the head combustion chamber is then mixed with the hot residual RVCC gas. Injection of hot fuel preheated by the block is injected near TDC to start combustion in stage two. Stage three, back in the head combustion chamber, is initiated by the increased pressure created by combustion in the RVCC. The stage three head combustion chamber charge is already heated in stage one, and is combusted by and mixed with hot combustion gas from stage two. As a result of this staged combustion, thermodynamic irreversibility losses are reduced, which by definition increases energy.

Another important point about the RVCC must be understood. The RVCC is designed to maximize the efficiency of this chamber. The spherical shape and the limited heat range reduce heat loss while maximizing the mixing of the fuel and air. This geometry is quite similar to conventional IDI pre-combustion chambers. Conventional IDI diesels are not as efficient as DI diesels due to increased heat and throttling loses generated by the combustion gas as it exits the pre-combustion chamber. The RVCC minimizes this problem with the use of the combustion valve. Since the combustion valve opens late in the compression cycle, not only is the charge already heated by compression, but a large pressure rise is already present when the valve opens. This allows the passage to be much larger to reduce throttling losses while still providing a high velocity stream to facilitate charge mixing. Further, in the RVE, the entire charge is not combusted in the RVCC as it is in conventional pre-combustion chambers. In the depicted engines, the RVD transfers about two thirds of the charge to the RVCC, while the RVE transfers about one half. This significantly reduces the volume of combusted gas passing through the passage from the RVCC. In addition, coating the RVCC and passage with ceramics insulates these surfaces to dramatically reduce heat transfer. Increasing both the size and insulation level of the passage while decreasing the volume of gas passing through it, significantly reduces heat and throttling losses. Although throttling losses are reduced, some throttling slows the flow of combustion gas from the RVCC slowing the total combustion event. More control of this process can be realized by regulating the fuel injection to keep the RVCC pressure within a smaller pressure range. This provides the opportunity to better match the heat energy produced in the RVCC with the speed of the piston to more efficiently utilize the heat availability while also reducing heat loss. Also, it provides the benefit of increasing torque making the engine more powerful. However, throttling reduces the jet kinetic energy which then reduces the available energy to ignite the head combustion chamber charge. This is not a major concern since the RVCC charge is relatively large and will produce a significant pressure rise in both chambers when combustion is initiated. This pressure rise should be more than adequate to ignite the head combustion chamber charge through Homogenous Charge Compression Ignition (HCCI). If not, the jet originating from the RVCC should ignite it. Although some throttling losses may increase heat loss in the RVCC, the use of the RVCC with the other enabled elements should increase overall engine efficiency.

Stage three combustion in the head combustion chamber is intended to be the final stage but this might not be the case under certain conditions. These conditions are influenced by the size of the combustion valve opening and resultant charge pressure, fuel concentration, and type of fuel. If using a fuel with a relatively low ignition point such as diesel, care must be taken to keep the fuel mixture dilute enough to resist early ignition. Also, the opening of the compression valve must be large enough to allow a sufficient flow of the charge to pass through it to avoid increasing the combustion pressure and temperature above the fuel ignition temperature. Fuels with higher ignition points such as gasoline would be more resistant to higher pressure and temperature levels. Having said this, combustion originating in the head combustion chamber or simultaneously with the RVCC charge is not a problem as long as it occurs at TDC or after although it is expected the most efficient operation of the RVE is produced by ignition originating in the RVCC.

The relative sizing of the RVCC and the head combustion chambers will influence the performance of the engine. Increasing the RVCC relative to the head combustion chamber significantly increases output. It also increases thermal efficiency because a larger percentage of the total combustion surface is kept in a smaller heat range which should reduce heat transfer losses. It also may reduce emissions because the larger chamber provides more volume to avoid wall wetting and adds a significant volume of EGR. The head combustion chamber is sized to provide enough space to keep the compressed charge below the ignition temperature until the piston is near TDC and to allow some distance between the piston and jet produced by the RVCC to prevent scorching of the piston. However, scorching is further minimized by the jet being rotated over the piston during operation.

One last point about the RVCC is of note. Conventional engines can be designed with similar combustion chamber geometry to produce a similar output. However, the RVE uses the rotary valve assembly in conjunction with the combustion valve to allow the same combustion chamber to serve all cylinders. Not only does this reduce the heat loss of the combustion chambers, but the size, complexity and cost of the engine as well.

Several points concerning the variable compression valve are noteworthy. This valve is designed to perform several functions. First, as previously cited, it transports gas from the combustion cycle to the compression cycle to fine tune EGR requirements. Second, since it moves this gas while the intake, exhaust, and combustion valves are closed, it also increases the compression ratio. Third, with the valve timed to open just after the arrival of combustion pressures and temperatures and close before the compression pressure equals the combustion pressure, it also transports radical species formed during combustion to the cylinder undergoing compression. To prevent premature ignition of the compression charge, the flame front is quenched by the small passages of the variable compression valve. The radicals now contained in the compression charge increases thermal efficiency by promoting more complete combustion. Radicals also reduce ignition delay by reducing the required ignition temperature. In the head combustion chamber, early injection of fuel and the presence of the induced radicals promote HCCI. Since, varying the opening of the variable compression valve controls the compression ratio, quantity of EGR and radicals transferred to the compression cycle, it also controls the pressure and temperature at which the charge can be ignited.

Next, the RVE uses staged combustion to increase combustion stability. Each combustion chamber is served by a discrete fuel injector. Thus each injector can be electronically regulated to produce a system where a slightly richer charge ignites a more dilute charge. Compared to DI stratified systems, this stratified system offers superior charge differentiation allowing very lean and stable combustion over a greater range of engine speed and load conditions. Current efforts to reduce emissions are concentrating on various methods of low temperature combustion, including HCCI. Unfortunately in conventional engines, HCCI combustion is stable only at mid load ranges. In the RVE, the low load range is extended by the high pressure rise generated by the RVCC producing a large temperature increase and the high energy jet producing more energy to initiate the head combustion charge as it rotates over the cylinder. Also, transportation of radical species into the compression charge lowers the temperature required to start combustion. Both increase ignition reliability. In still lower load conditions, the RVE completely eliminates combustion in the head combustion chamber relying on the RVCC charge to produce the required output. In high load conditions, ignition starts with the injection of fuel into the RVCC or by the spark plug if using a SI fuel. Both are further controlled by the variable compression valve changing the compression ratio, EGR rate, and quantity of radical species present. These conditions and opening the combustion valve retard the heat rise to prevent pre-ignition in high load conditions.

The RVE mixes the fuel and air better than conventional engines. Fuel is initially injected into the intake charge. This allows more time for the fuel to mix with the air before it is combusted. During the compression cycle, injection of non-burning jets of combustion chamber gas by the variable compression valve increases mixing of the compression charge by adding turbulence to reduce compression induced thermal stratification. After the combustion valve is opened, the mixture rushes into the RVCC where additional fuel is injected into it as it is swirled at great velocities to promote very rapid mixing. The jet produced by combustion of this charge then further mixes and aids in combustion of the head combustion chamber charge as the combustion valve moves across the cylinder. This thorough mixing minimizes the amount of fuel needed to provide stable combustion.

The three stage stratified charge HCCI operation reduces fuel consumption. In the RVD, lower temperature HCCI conditions are produced by the high EGR rates and radical combustion allowing a more dilute charge to provide reliable combustion. In the SI RVE, HCCI, high EGR, and radical combustion allow using higher compression ratios which increases thermal efficiency to reduce fuel consumption. Further, again in both, under light load conditions, completely eliminating the initial intake fuel charge and having the RVCC injector supply only enough fuel to reliably ignite the RVCC mixture further reduces fuel use. This strategy would be limited in diesel operation due to the need to maintain a minimum pressure and temperature for auto-ignition. Also, as the RVD seals are lubricated by the charge, lubricating jets would be used to prevent excessive friction. Further, most engine applications require a certain range of power. Since the RVE dramatically increases output, the displacement of the engine can be reduced to cut fuel consumption while still providing the required power. In addition, in an "H" configuration eight cylinder RVE, one set of four cylinders can be deactivated during light load conditions. Lastly, being the RVE engine is lighter; the vehicle weight will be lower to further cut fuel consumption. Utilization of all the aforementioned strategies would produce very substantial fuel savings in the RVE.

The RVE combustion system also reduces emissions. The compound combustion system describes a very practical stratified combustion system where a very highly mixed lean mixture ignites a still leaner homogeneous charge. The very lean combustion conditions created by high EGR rates, radical insertion, and HCCI allow stable and complete combustion at lower temperatures which reduces both NOx and soot. These conditions are enabled by electronic control of the supercharger, variable compression valve, and fuel injectors to regulate the oxygen and fuel ratios in each combustion chamber. Further, low temperature combustion produces a lower combustion pressure which reduces blow-by. Any blow-by past the valve seals ends up in the annular cavity to be burned in the next cycle. Conventional methods control blow-by past the pistons. Also, the RVCC is used to initiate every combustion stroke and all cylinders are served by the same short single intake and exhaust passage reducing engine warm-up emissions. The use of seal plates reduces crevice space and using a lubricating fuel such as diesel can replace the oil in the lubricating jets to reduce HC emissions. Higher exhaust temperatures derived from reduced heat transfer and increased energy allow more effective use of after-treatment devices. However, the most effective control measure is the significant CO2 reduction due to increased efficiency reducing fuel consumption. All these elements produce substantial reductions in RVE emissions.

The RVE volumetric efficiency is unmatched by any internal combustion engine. The RVE can pump three times the normal volume of air through the engine. To avoid excessive air pumping throttling losses, this art improves the volumetric efficiency by further increasing the size of both the intake and exhaust valve openings. Conventional pumping efficiency is limited by the necessity to have both the intake and exhaust valves be present in the same physical space in the head. In these engines, the maximize size of the valve area can only be as great as 32% of the cylinder bore. The RVE is not bound by this requirement and can therefore increase the intake and exhaust valves to be as large as the bore or larger. Intake and exhaust valve and passage cross-sectional areas of more than three times conventional engines are possible with this format. Further, in SI operation the RVE reduces, if not eliminates, the need for throttled operation. This is brought about by the increased charge mixing produced, in part, by the combustion valve.

The RVE is more compact and lightweight than conventional engines. As previously noted, the RVE combustion system enables substantial increases in output. Charge pressures greatly exceeding current levels are possible. These charge pressures can be safely utilized because the combustion system decreases the peak combustion pressure thereby reducing the strength and sealing requirements of the engine. To match the output in a conventional engine, either the total engine displacement or the compression ratio would be significantly increased. Either option substantially increases the size and weight of the engine.

The next benefit is increased power-to-weight ratio. This benefit is derived by increasing both thermal and pumping efficiencies which increases output without increasing engine cylinder displacement. Due to sharing of some components, the "H" eight cylinder RVE can achieve even greater power-to-weight ratios.

Another major advantage of the RVE is reduced noise, vibration and harshness (NVH). Noise is greatly reduced by the staged combustion system while the vibration and harshness are minimized by the counter-rotating crankshafts and rotating rotary valve replacing reciprocative poppet valves. While the four cylinder engine would demonstrate good NVH, the "H" eight cylinder would be superior. Both versions should outperform their conventional counterparts.

The next advantage is reduced cost. First, the RVE uses one rotary valve, one high-pressure injector, and one rotary valve combustion chamber for four cylinders. Also, the single rotary valve performs numerous functions, which would require several separate systems in conventional engines. Together, this reduces the number of required parts. Second, the advanced combustion system reduces the need for expensive emissions after-treatment devices. Third, being more compact, the engine requires less space thereby reducing the total vehicle size. Forth, in the RVD, lower combustion pressures reduce the strength requirements of the engine. Finally, it is more economical to operate due to the simplicity of the design and reduced fuel use.

Probably the greatest advantage of the RVE is consumer acceptance. This powerful, low cost, high fuel mileage, and low emissions engine should be very competitive in a broad spectrum of lightweight land, air, and marine vehicle markets. As ever greater fuel economy and emissions standards are imposed, conventional engines will suffer performance and cost penalties reducing their market demand. This will make the RVE very attractive to manufacturers supplying these markets while concurrently contributing to societal efforts to reduce global warming.

While the preferred embodiment is a single valve four cylinder, other forms using most of the elements described can be used. FIG. 11 demonstrates using two single rotary valves with each valve serving two cylinders to produce a single crankshaft inline four cylinder engine. Compared to the RVE previously described, this inline four cylinder has several advantages and disadvantages. In addition to the single crankshaft, other advantages include greater flexibility in setting engine firing order and less demanding heat management. Disadvantages include: incapable of incorporating the variable compression valve, requires twice the number of rotary valves, injectors and associated parts making it more costly, not as compact, and probably is not as thermodynamically efficient. However, it should outperform comparable conventional engines.

The increased engine efficiency of the RVE is of little use unless it can be built. The basic RVE design is adapted to the NSU rotary valve engine successfully used in motorcycle racing. Excessive seal wear, which was a major limiting factor of the NSU engine, is remedied in the RVE. Unlike the NSU engine, the RVE seal system avoids using combustion pressures to increase pressure on the seals. Instead, it uses floating seal systems or a ring system where the combustion pressure acts on the seals at 90 degrees. Care is also taken to avoid pushing the seals against moving parts of the engine at combustion pressures which would cause excessive wear. In fact, the RVE can utilize the same seal design developed for use in the Wankel rotary engine and eventually proved to be very reliable. Although not a proven technology, the alternatively proposed seal plates offer the advantage of sealing to the edge of the cylinder. This allows the engine to be more compact and also reduces crevice space to reduce HC emissions. To avoid the valve seizing problem encountered by the Aspin rotary valve engine, enough clearance is provided at the top of the valve and the bottom of the rotary valve shaft to allow thermal expansion of the valve and small vertical valve movement without any contact with either the rotary valve bearing housing or the block below the shaft. Minor movement of the rotary valve will not affect sealing because the seals are designed to accommodate this. Ceramic coatings are used in high thermal gradient areas to prevent thermal deformation in the RVCC and passage, bottom surface of the valve, combustion and exhaust seals, variable compression valve, compounding element and, if desired, the exhaust passage. The rotary valve is cooled by oil pumped through the valve in a similar manner to the NSU rotary valve engine. Again like the NSU engine, this oil system also cools the valve bearings. Therefore, normal bearings should offer adequate service, but ceramic bearings could be used if needed. Combustion seals are lubricated using a lubricating fuel or by recently developed synthetic lubricants. Electronic control is enabled by various sensors. While most are already developed, additional more sophisticated sensors could further optimize performance. From this discussion, it should be apparent the technology already exists to build the advanced combustion RVE. All that is needed to develop this engine to slow world oil demand and the pollution from its use is the motivation and resources to build it.

Based on the foregoing, it is a primary object of the present invention to provide a rotary valve engine which has a greater thermal efficiency than conventional poppet valve engines.

Another object of the present invention is to increase the pumping efficiency as compared to conventional poppet valve engines.

Yet another object of the present invention is to increase the fuel economy when compared to conventional poppet valve engines.

An additional object of the present invention is to increase the total output as compared to conventional poppet valve engines.

A further object of the present invention is to reduce emissions as compared to conventional poppet valve engines.

Another object of the present invention is to make the engine more compact than conventional poppet valve engines.

An additional object of the present invention is to increase the power-to-weight ratio as compared to conventional poppet valve engines.

Yet another object of the present invention is to reduce the noise, vibration and harshness in comparison to conventional poppet valve diesel engines.

Another object of the present invention is to reduce the manufacturing cost as compared to conventional poppet valve engines of equal capability.

A final object of the present invention is to at least equal the reliability of conventional poppet valve engines.

Other objects and advantages of the present invention will become apparent and obvious from a study of the following description and accompanying drawings which are merely illustrative of such invention.

DETAILED DESCRIPTION OF THE INVENTION

Figure 1:
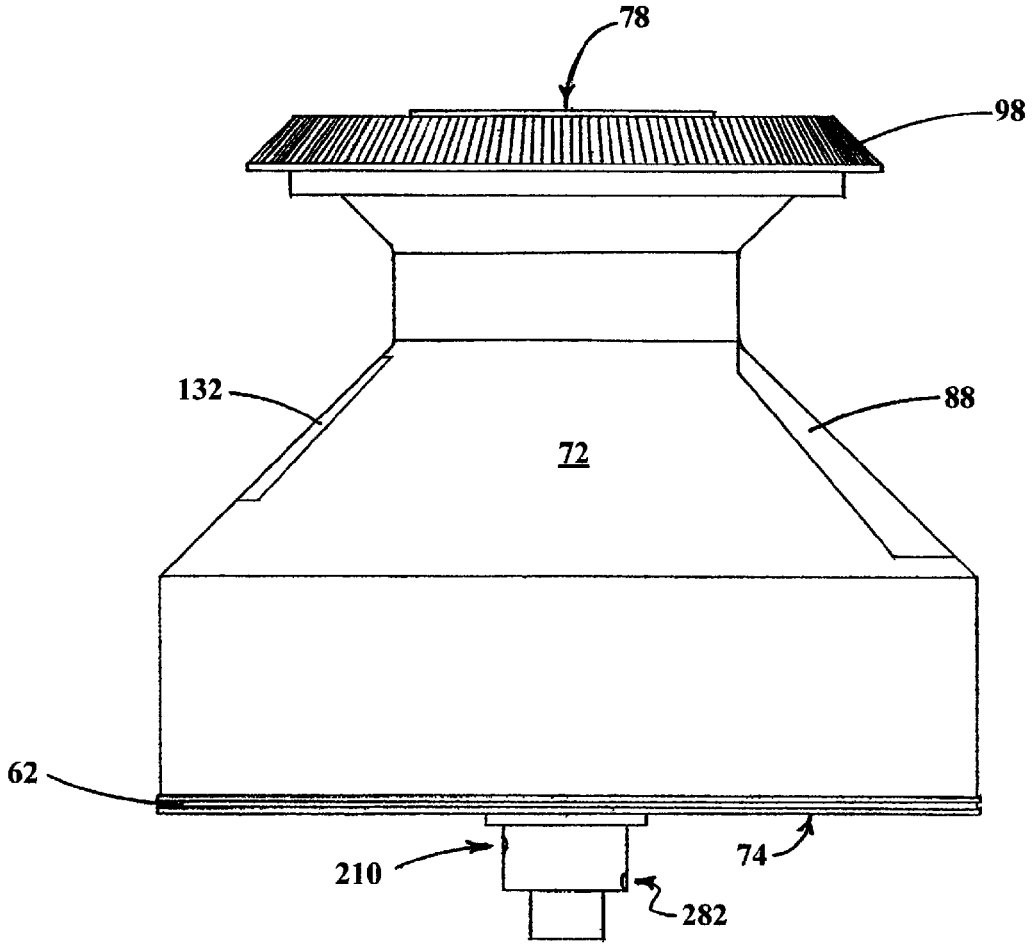
FIG. 1 is an elevation view of the rotary valve.

Referring now to the drawings, the preferred embodiment of the rotary valve engine of the present invention is shown therein and indicated generally by the numeral 10. The rotary valve engine 10 includes an engine block 20 having a plurality of cylinders 22 in which reciprocating pistons 24 are mounted. A rotary valve assembly 70 is disposed on the top of the engine block 20 for directing air into cylinders 22 and exhausting combustion gases. The rotary valve assembly 70 comprises a valve housing 100, a single disc-type rotary valve 72, and rotary valve bearing housing 104 for each group of cylinders. The engine block 20 encloses cylinders 22 which are circumferentially spaced about the axis of rotation of rotary valve 72. The center of each cylinder 22 is equidistant from the rotational axis of rotary valve 72. A piston 24 is mounted for reciprocating movement within each cylinder 22. Each piston 24 is connected by a piston rod 38 to a rotating crankshaft 40. Two parallel crankshafts 40, each with anti-backlash gear 42 mesh with one another. As the anti-backlash gears 42 mesh together, the two crankshafts 40 will rotate in opposite directions. Each crankshaft 40 includes two crank throws 44 to which respective piston rods 38 are connected. The crank throws 44 on each crankshaft 40 are disposed 180 degrees apart from one another. Thus, even though the circular path of travel of the crank throws on opposite crankshafts overlap, the crank throws avoid contact by being out of phase with one another. This allows the crankshafts to be placed closer together making the engine more compact while the counter rotating crankshafts reduce engine vibration. On the end of one of the crankshafts is a pulley driving a belt to a second pulley to drive bevel gear 56. Bevel gear 56 drives bevel gear 98 mounted on the top of rotary valve 72 driving it at one half the crankshafts speed. Rotary valve 72 includes an exhaust passage 76 and an intake passage 84. The exhaust passage 76 includes an inlet 77 on the bottom of rotary valve 72 and an outlet 78 at the top of rotary valve 72 along the axis of rotation of the rotary valve 72. Compounding fins 80 located in exhaust passage 76, are angled or curved to exert a rotating force in the same direction of rotation of rotary valve 72 to increase output. Outlet 78 connects to exhaust passage 112 located in rotary valve bearing housing 104. Seal 114 prevents the escape of exhaust gas. Inlet 77 of the exhaust passage 76 is positioned such that it communicates with each cylinder 22 in succession as rotary valve 72 rotates. The intake passage 84 includes an inlet 86 disposed at the beginning of intake passage 84 within rotary valve 72 extending to the bottom surface 74 of rotary valve 72 and intake outlet 88. Fins 111 located on the outside of rotary valve housing 100 cool the intake charge. Restraining rotary valve 72 in place is rotary valve bearing housing 104. Bearings 140 on top of rotary valve 72 counter the bulk of the cylinder gas pressures while lower bearing 141 supports the bottom of rotary valve 72.

Figure 2:
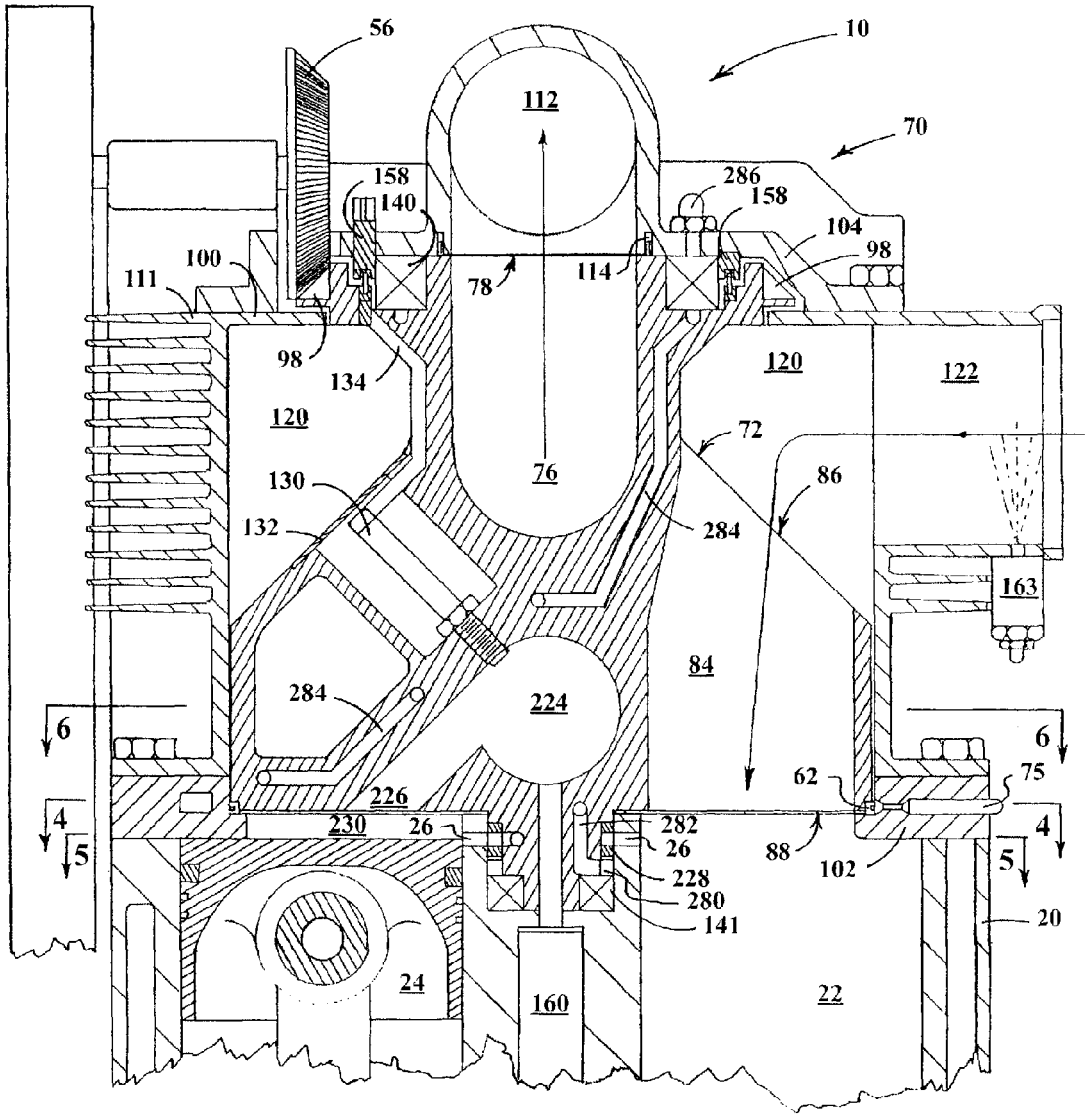
FIG. 2 is a diagonal cross-section of the Rotary Valve Engine through 2-2 of FIG. 4.
Figure 3:
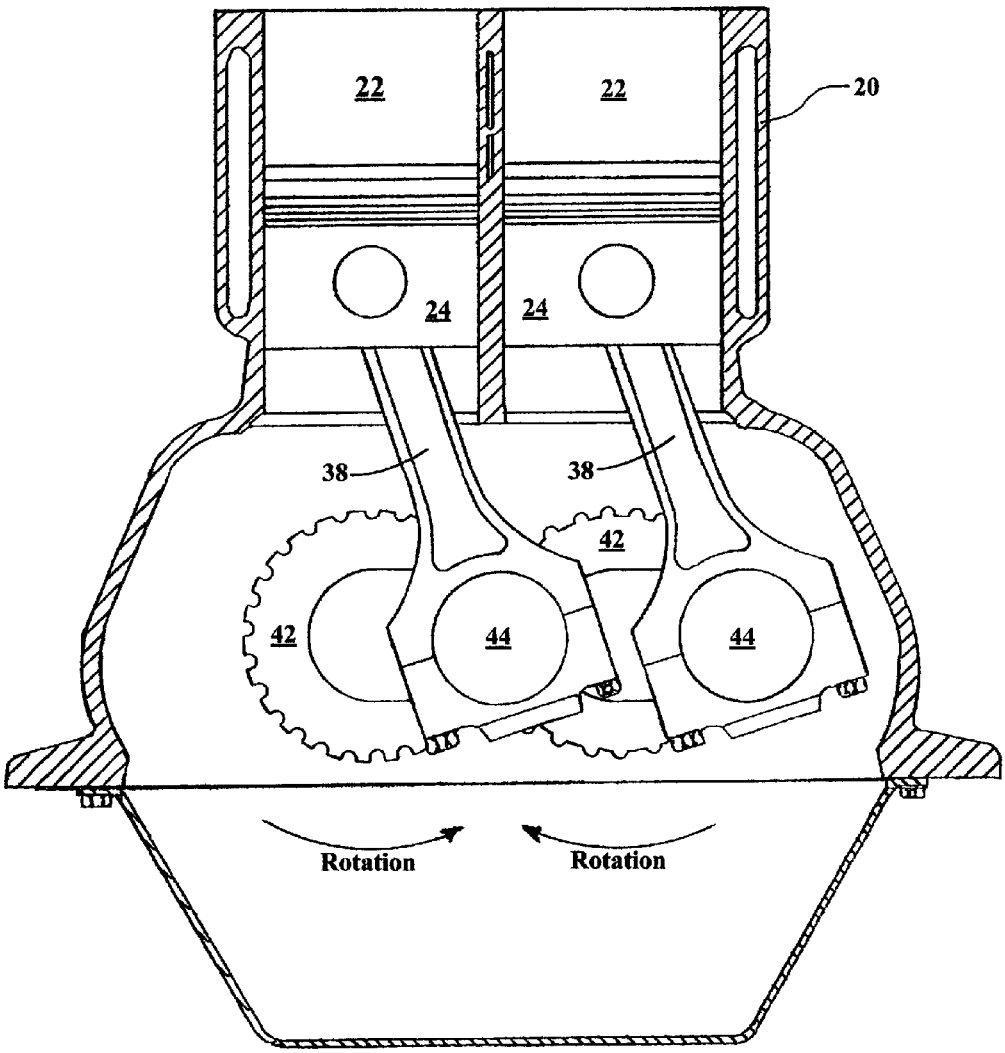
FIG. 3 is a cross-section of block through 3-3 of FIG. 4.
Figure 4:
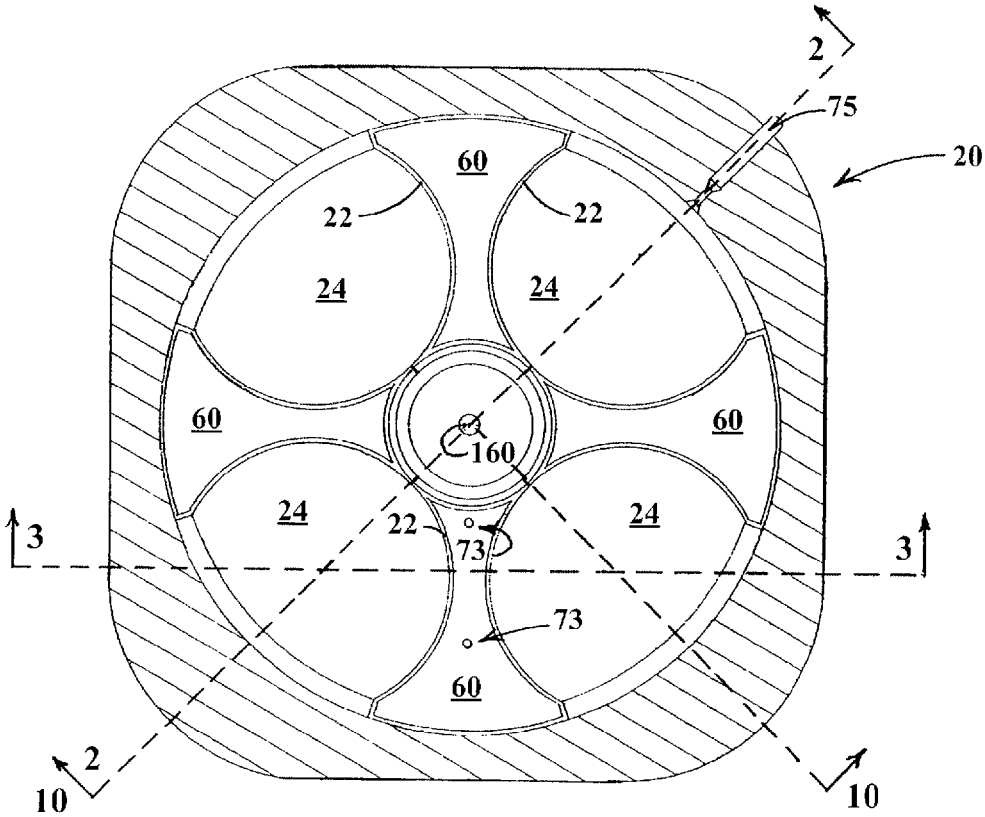
FIG. 4 is a cross-section of the cylinder heads through 4-4 of FIG. 2.
Figure 5:
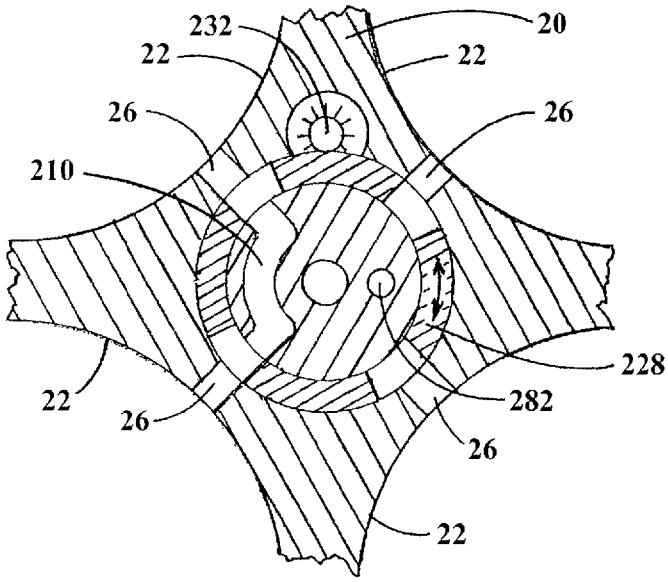
FIG. 5 is a broken section of the center of the block and variable compression valve through 5-5 of FIG. 2.
Figure 6:
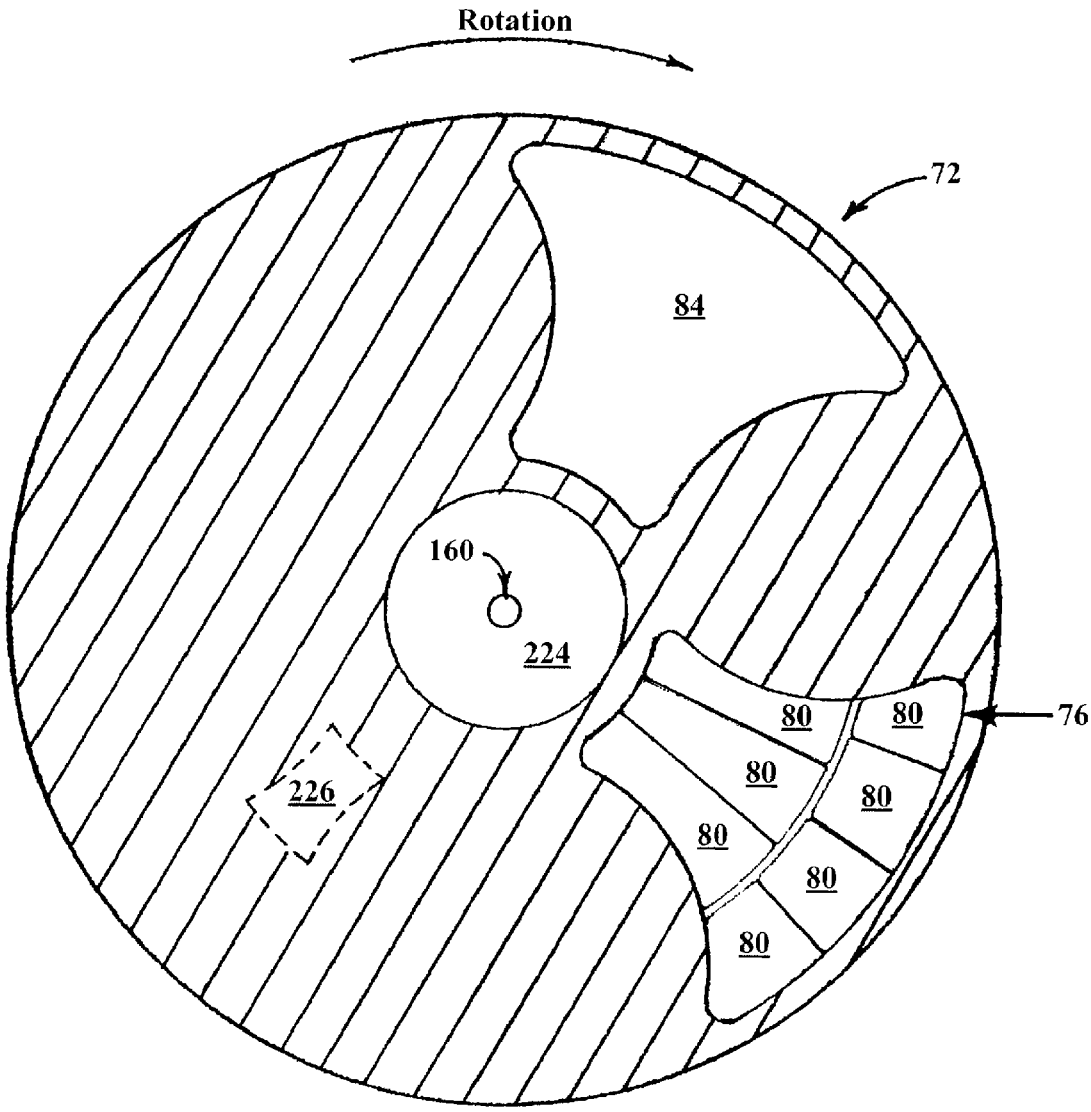
FIG. 6 is a cross-section of the rotary valve through 6-6 of FIG. 2; with hidden lines showing the combustion valve.
Figure 7:
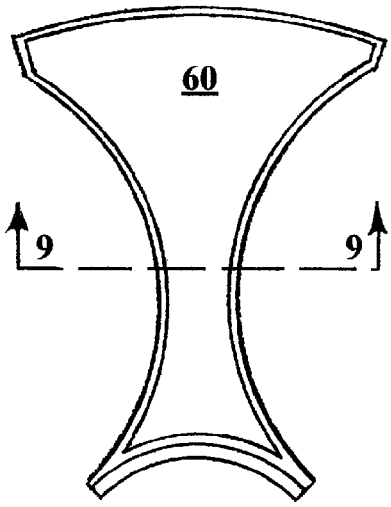
FIG. 7 is a top view of the floating cylinder seal plate between cylinders.
Figure 8:
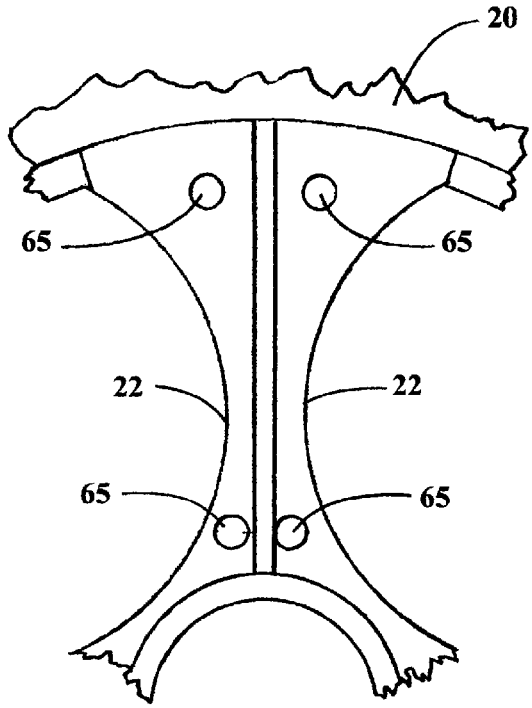
FIG. 8 is a top view of the block under the cylinder seal plate of FIG. 7.
Figure 9:
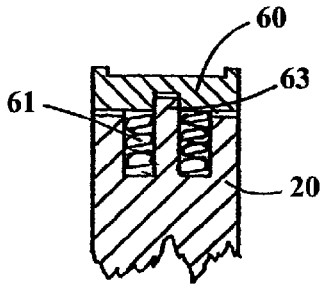
FIG. 9 is a cross-section through cylinder seal plate at 9-9 of FIG. 7 and the block between cylinders of FIG. 8.

The rotary valve engine design can be incorporated in both SI and diesel forms. Both forms utilize a unique combustion system. First, as shown in FIG. 2, orifice 26, part way down cylinder 22, opens to a movable ring 228 which is controlled by electric motor 232. This varies the opening of movable ring 228 from closed to totally open changing the volume of gas entering variable compression valve 210 during the compression cycle. Variable compression valve 210 is closed to facilitate engine starting. During operation, combusted gas is transferred from an adjacent cylinder undergoing the combustion cycle through its respective opening 26 and through variable compression valve 210 to change EGR and radical species transport rates, and the compression ratio. Located above the cylinders 22 is head 102 which defines head combustion chamber 230 above piston 24. Combustion valve 226 located on the bottom of rotary valve 72, rotates over cylinders 22 in succession enabling gas to enter rotary valve combustion chamber (RVCC) 224 from head combustion chamber 230 near the end of the compression cycle. Centrally located in block 20 and serving all cylinders, is high pressure injector 160 which injects preheated fuel into RVCC 224. Expanding combustion gas increases pressure within RVCC 224 and exits through combustion valve 226 to ignite the mixture in head combustion chamber 230.

Figure 10:
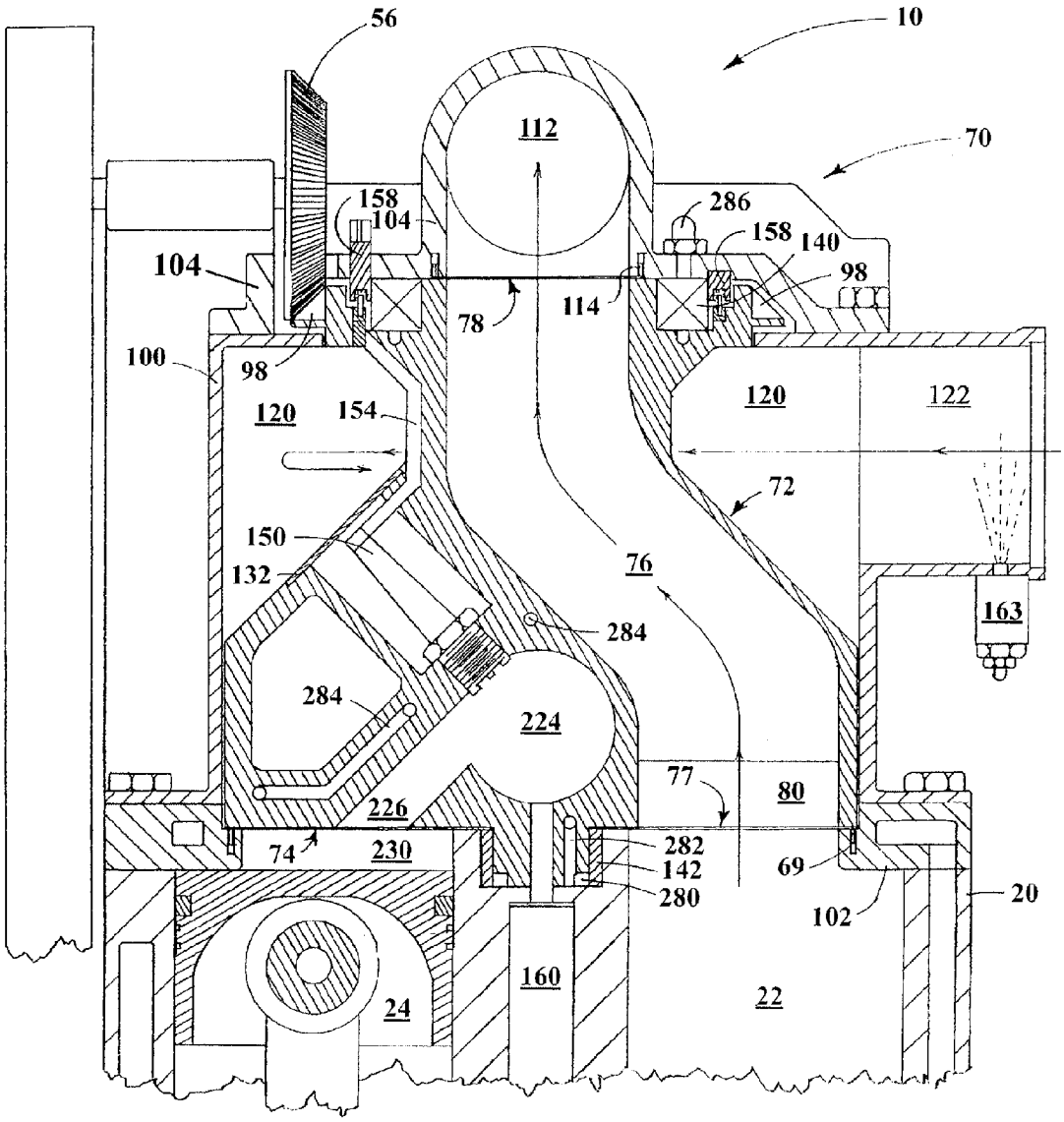
FIG. 10 is a diagonal cross-section of the spark ignited Rotary Valve Engine through 10-10 of FIG. 4.
Figure 11:
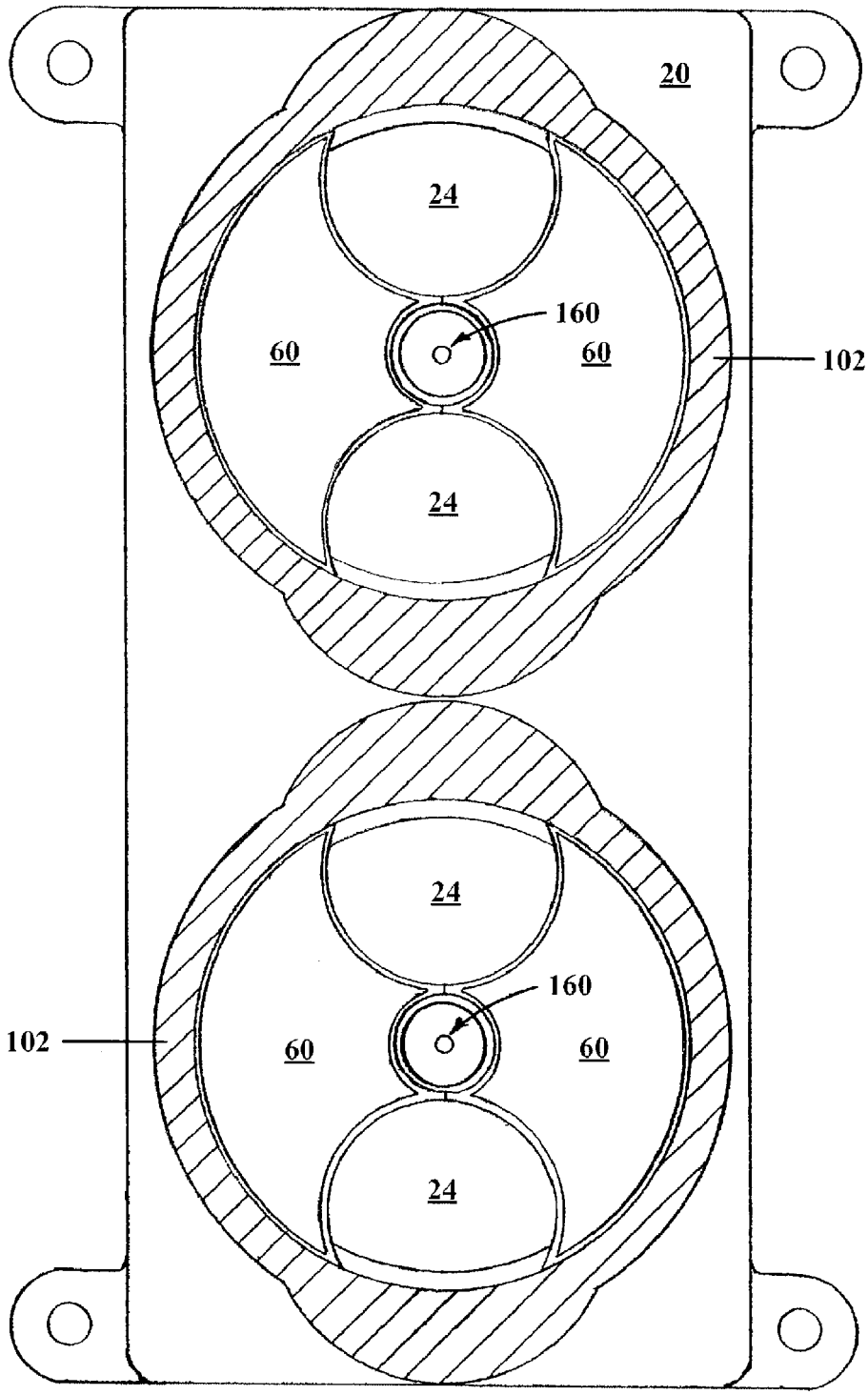
FIG. 11 is a cross-section of the cylinder heads of a single crankshaft inline four cylinder engine in a similar manner to FIG. 4.

Contact ring 158 provides electrical power to rotary valve 72 via spark plug wire 154 leading to spark plug 150. (See FIG. 10) In the RVD, glow plug wire 134 connects to glow plug 130 to heat the RVCC 224 in cold starting conditions. Electrical cover 132 seals the glow plug or spark plug access chambers.

Of critical importance is the seal system used to control the engine gases. A piston ring type seal 62 is located on the bottom edge 74 of the rotary valve 72 and is lubricated by lubricating nozzle 75 or by a lubricating fuel. Seal plates 60 are positioned on top of block 20 and between cylinders 22 to prevent the movement of gas between cylinders. Flange 63 restricts the horizontal movement of seal plate 60 as seal plate 60 has pressure exerted on it by engine gases. Spring 61 seated in spring depression 65 pushes seal plate 60 tightly against the bottom surface 74 of rotary valve 72. Seal 69 (RVE) located in head 102 and below the outside edge of rotary valve 72 uses a spring and seal system similar to the side seals of the Wankel Rotary Engine preventing movement of gas past rotary valve 72. All combustion chamber seals are lubricated by a combination of the fuel (RVD), lubricating injector 75 located in the head, and in the SI RVE, by lubricating injectors 73 located between cylinders 22. As seal plates 60 are located on the edge of cylinders 22, they allow the engine to be more compact while also reducing crevice space volume to reduce HC emissions.

To prevent thermal deformation of rotary valve 72, several elements are used. Pressurized oil circulating through engine block 20 is fed into oil channel 280. Oil enters the shaft of rotary valve 72 through oil passage 282 and cools valve 72 as it travels through various passages 284 to exit valve 72 through the upper bearings 140 via oil passage 286. Additionally, ceramic coatings are used in critical sections of rotary valve 72 such as RVCC 224 and its passage, variable compression valve 210, exhaust passage 76, and the bottom surface 74 of rotary valve 72. Finally, lubricating injector 75 cools rotary valve ring seal 62 as it lubricates it.

Now, considering the operation of the Rotary Valve Diesel (RVD), the process is initiated by the supercharger compressing the intake at three times' conventional pressure. As this charge passes through intake opening 122, injection of fuel by low pressure fuel injector 163 mixes with the intake air during the intake and compression strokes. Then variable compression valve 210 transfers gas from the power stroke of an adjacent cylinder to enter the cylinder 22 undergoing compression to increase the compression ratio, EGR, and radical species volumes. Variable compression valve 210 is timed to open just after the arrival of the radical species generated by the combustion in RVCC 224 and to close as determined by operating conditions, but before the pressure of the compression cylinder equals the pressure of the combustion cylinder. As exhaust valve opening 77 from the previous cycle closes or at about 26 CA BTDC, combustion valve 226 opens allowing gas to enter the RVCC 224. Since this chamber volume is approximately double the head combustion chamber 230 volume and contains residual gas at the final exhaust pressure, about two thirds of the charge rushes into RVCC 224. The rate of pressure rise of the charge slows due to the added volume of RVCC 224 as the rising piston increases the pressure to that necessary to initiate combustion. Just before combustion valve 226 is completely open at 10 CA ATDC, fuel is injected into RVCC 224 by high pressure fuel injector 160. RVCC 224 is sized to avoid excessive fuel wetting of the chamber walls. Heat from the pressure rise generated by compression ignites the fuel. The expanding gas inside RVCC 224 exits into head combustion chamber 230 through combustion valve 226 as it rotates above head combustion chamber 230. The pressure rise and forceful jet generated by the combustion in RVCC 224 mixes and ignites the very lean charge in head combustion chamber 230. The force of combustion moves piston 24 downward turning crankshaft 40. Gas exits through combustion valve 226 as it crosses cylinder 22 until it closes and exhaust valve 77 opens. The process is repeated using the same RVCC 224 and combustion valve 226 to produce pulsating jets of hot gas during each successive power stroke. Exhaust gas is pushed into exhaust gas passage 76 by the upward movement of piston 24 applying pressure against compounding fins 80 as it moves through them increasing output. The exhaust progresses up exhaust passage 76 to finally exit through exhaust opening 78.

Operation of the SI Rotary Valve Engine (RVE) is similar. Combustion is initiated by either auto-ignition or by spark plug 150. In contrast to the RVD, the RVE uses plain bearings 142 instead of ball bearings 141. Further, cooling fins are not used to cool intake housing 100 because the intake charge is heated in the annular cavity 120 by residual exhaust and combustion heat. In addition, more space in head 102 allow using Wankel rotary engine type seals 69 instead of ring type seals 62 on the bottom edge of rotary valve 72. Although not shown, rotary engine type side seals can also be used in the block 20 in place of seal plates 60. Finally, lubricating injector 73 situated between cylinders 22 lubricates the bottom of rotary valve 72 and seal plates 60.

Regarding a single valve serving two cylinders, operation is similar to the RVE. However, the variable compression valve cannot be utilized due to the lack of adjacent firing cylinders.

Based on the foregoing, it is apparent the rotary valve engine of the present invention has numerous advantages over conventional poppet valve engines. First, it should a have higher thermodynamic efficiency. Second, it should have higher volumetric efficiency. Third, it should be more compact. Forth, it should have superior emissions characteristics. Fifth, it should be more fuel efficient. Sixth, the rotary valve engine should have a higher power-to-weight ratio. Seventh, it should exhibit lower noise, vibration and harshness than conventional diesels. Lastly, the rotary valve engine should be less costly to manufacture.

The present invention may of course, be carried out in other specific ways than those herein set forth without parting from the spirit and essential characteristics of the invention. The presented embodiments are, therefore, to be in all respects as illustrative and not restrictive, and all changes coming within the meaning and equivalency range of the appended claims are intended to be embraced therein.

What is claimed is:

1. A rotary valve engine with a four stroke cycle, the rotary valve engine comprising:

an engine block having one or more cylinders;

one or more drive members mounted in respective cylinders;

one or more crankshafts rotatably mounted to the engine block and driven by the drive member;

a disc-type rotary valve mounted on the engine block;

an intake passage formed in the rotary valve for directing air into the one or more cylinders as the rotary valve rotates;

an exhaust passage formed in the rotary valve for exhausting combustion gases from the one or more cylinders as the rotary valve rotates;

a rotary valve combustion chamber located within the rotary valve; and a combustion valve disposed within the rotary valve for transferring gas from the one or more cylinders to the rotary valve combustion chamber.

2. The rotary valve engine of claim 1 further comprising a passage to connect the rotary valve combustion chamber to the combustion valve.

3. The rotary valve engine of claim 1 further comprising a first fuel injector located in the center of the engine block to inject fuel into the rotary valve combustion chamber.

4. The rotary valve engine of claim 1 further comprising a seal plate extending around said cylinders, the seal plate being shaped to conform to the area located between the one or more cylinders and the head.

5. The rotary valve engine of claim 4 wherein said rotary valve combustion chamber includes an opening for communicating with said cylinders, and wherein a leading edge of said opening is shaped to conform to a shape of said seal plate.

6. The rotary valve engine of claim 1 further comprising a valve housing surrounding the rotary valve and defining an annular cavity, and an intake passage extension attached to the valve housing.

7. The rotary valve engine of claim 3 wherein the intake passage extension contains a second fuel injector.

8. The rotary valve engine of claim 1 further comprising a head having one or more head combustion chambers, said head combustion chambers disposed between said cylinders and said rotary valve combustion chamber.

9. The rotary valve engine of claim 8 wherein combustion initiated in said rotary valve combustion chamber ignites gases in said head combustion chamber.

10. The rotary valve engine claim 8 wherein combustion initiated in said head combustion chamber ignites gases in said rotary valve combustion chamber.

11. The rotary valve engine claim 1 further including a plurality of oil passages contained within the rotary valve to cool the disc-type rotary valve.

12. The rotary valve engine claim 1 further comprising O-rings seals seated against the bottom of the rotary valve and an oil injector to lubricate the "O" ring seals.

13. The rotary valve engine with a four stroke cycle, the rotary valve engine comprising:

an engine block having at least one cylinder;

a drive member mounted in the cylinder;

a rotating crankshaft mounted to the engine block and driven by the drive member;

a disc-type rotary valve mounted on the engine block;

a rotary valve shaft extending from the center of the disc-type rotary valve;

an intake passage formed in the rotary valve for directing air into the cylinder as the rotary valve rotates;

an exhaust passage formed in the rotary valve for exhausting combustion gases from the cylinder as the rotary valve rotates; and a variable compression valve disposed on the rotary valve to recirculate gas generated during a combustion cycle in a first cylinder to a second cylinder during its compression cycle to vary the compression ratio attained in the second cylinder.

14. The rotary valve engine of claim 13 wherein the variable compression valve comprises a movable ring encircling said rotary valve shaft.

15. The rotary valve engine of claim 14 further comprising an electric motor to vary the opening of the movable ring to vary the volume of gas passing through the variable compression valve.

16. The rotary valve engine of claim 13 wherein the variable compression valve transports radical species from a first cylinder in a combustion cycle to a second cylinder in a compression cycle.

17. A rotary valve engine with a four stroke cycle, the rotary valve engine comprising:

an engine block having one or more cylinders;

one or more drive members mounted in respective cylinders;

one or more crankshafts rotatably mounted to the engine block and driven by the drive member;

a disc-type rotary valve mounted on the engine block;

an intake passage formed in the rotary valve for directing air into the one or more cylinders as the rotary valve rotates;

an exhaust passage formed in the rotary valve for exhausting combustion gases from the one or more cylinders as the rotary valve rotates;

a rotary valve combustion chamber located within the rotary valve; and a fuel injector located in the engine block to inject fuel into the rotary valve combustion chamber.

18. The rotary valve engine of claim 17 further comprising a seal plate extending around said cylinders, the seal plate being shaped to conform to the area located between the one or more cylinders and the head.

19. The rotary valve engine of claim 18 wherein said rotary valve combustion chamber includes an opening for communicating with said cylinders, and wherein a leading edge of said opening is shaped to conform to a shape of said seal plate.

20. The rotary valve engine of claim 17 further comprising a valve housing surrounding the rotary valve and defining an annular cavity, and an intake passage extension attached to the valve housing.

21. The rotary valve engine of claim 20 wherein the fuel injector located in the engine block is a first fuel injector and wherein the intake passage extension contains a second fuel injector.

22. The rotary valve engine of claim 17 further comprising a head having one or more head combustion chambers, said head combustion chambers disposed between said cylinders and said rotary valve combustion chamber.

23. The rotary valve engine of claim 22 wherein combustion initiated in said rotary valve combustion chamber ignites gases in said head combustion chamber.

24. The rotary valve engine claim 22 wherein combustion initiated in said head combustion chamber ignites gases in said rotary valve combustion chamber.

25. The rotary valve engine claim 17 further including a plurality of oil passages contained within the rotary valve to cool the disc-type rotary valve.

26. The rotary valve engine claim 17 further comprising O-rings seals seated against the bottom of the rotary valve and an oil injector to lubricate the "O" ring seals.

27. The rotary valve engine claim 17 includes a fuel line extending through the block to said fuel injector and the fuel in the fuel line and said fuel injector is preheated by the block.

28. The rotary valve engine claim 17 has a means to preheat the intake charge; said means is the counterflow heat exchange of the intake charge contained in said intake passage from exhaust residual heat contained within said exhaust passage.

29. The rotary valve engine claim 17 further has a means to increase pumping efficiency; said means is at least a 40% increase in the cross-sectional area of the intake passage and at least a 40% increase in the cross-sectional area of the exhaust passage.

* * * * *